US005772411A

United States Patent [19]

Crum et al.

[11] Patent Number: 5,772,411

[45] Date of Patent: Jun. 30, 1998

[54] GAS FLOW AND LUBRICATION OF A SCROLL COMPRESSOR

[75] Inventors: Daniel R. Crum; Bill P. Simmons, both of La Crosse; Arlo F. Teegarden, Stoddard; Jerry A. Rood; Peter A. Kotlarek, both of Onalaska, all of Wis.

[73] Assignee: American Standard Inc., Piscataway, N.J.

[21] Appl. No.: 611,586

[22] Filed: Mar. 6, 1996

Related U.S. Application Data

[62] Division of Ser. No. 418,340, Apr. 7, 1995, Pat. No. 5,533, 875.

[51] Int. Cl.[6] ..... F04B 17/00

[52] U.S. Cl. ..... 417/368; 418/55.1; 417/410.4

[58] Field of Search ..... 417/368, 371, 417/410.5, 410.4; 418/55.1, 55.6, 94, DIG. 1; 184/6.18

[56] References Cited

U.S. PATENT DOCUMENTS

| | | | |
|---|---|---|---|
| 4,496,293 | 1/1985 | Nakamura et al. | 417/371 |
| 4,564,339 | 1/1986 | Nakamura et al. | 417/366 |
| 4,592,703 | 6/1986 | Inaba et al. | 417/366 |
| 4,621,993 | 11/1986 | Nakamura et al. | 418/55 |
| 4,666,381 | 5/1987 | Butterworth | 418/55 |
| 4,702,681 | 10/1987 | Inaba et al. | 418/55 |
| 5,007,809 | 4/1991 | Kimura et al. | 417/371 |
| 5,176,506 | 1/1993 | Siebel | 417/368 |
| 5,240,391 | 8/1993 | Ramshankar et al. | 417/410 |
| 5,304,045 | 4/1994 | Hoshino et al. | 417/372 |
| 5,372,490 | 12/1994 | Fain | 418/55.6 |
| 5,533,875 | 7/1996 | Crum et al. | 417/368 |
| 5,591,018 | 1/1997 | Takeuchi et al. | 417/366 |

FOREIGN PATENT DOCUMENTS

| | | |
|---|---|---|
| 3601674 | 7/1986 | Germany . |
| 59-018287 | 1/1984 | Japan . |
| 59-7794 | 1/1984 | Japan . |
| 02045684 | 2/1990 | Japan . |

*Primary Examiner*—Timothy Thorpe
*Assistant Examiner*—Ted Kim
*Attorney, Agent, or Firm*—William J. Beres; William O'Driscoll; Peter D. Ferguson

[57] ABSTRACT

The flow, use, interaction and separation of lubricant and gas flowing through the suction pressure portion of a low-side refrigeration scroll compressor is managed by the use of a drive motor mounting sleeve and a multi-ported frame. The mounting sleeve and frame provide for the direction of oil to surfaces within the low side of the compressor shell which require lubrication as well as the conduct of suction gas to the scroll compression mechanism in a manner which cools the compressor drive motor yet which maintains the respective flows of oil and suction gas sufficiently separate to ensure that excessive amounts of oil are not conducted out of the compressor in the gas which is compressed thereby. Lubrication is enhanced by the use of a vent passage which opens into a relatively lower pressure region within the suction pressure portion of the compressor shell. The vent induces lift and assists in the delivery of oil, upward and through a gallery in the compressor's drive shaft, to the various surfaces in the upper portion of the compressor which require lubrication.

3 Claims, 5 Drawing Sheets

GAS FLOW AND LUBRICATION OF A SCROLL COMPRESSOR

This application is a division of application Ser. No. 08/418,340, filed Apr. 7, 1995, now U.S. Pat. No. 5,533,875.

BACKGROUND OF THE INVENTION

The present invention relates to scroll compressors. More specifically, the present invention relates to the controlled flow of lubricant and gas in and through a low-side scroll refrigerant compressor.

Low-side compressors are compressors in which the motor by which the compression mechanism is driven is disposed in the low or suction pressure portion of the compressor shell. In the case of a scroll compressor, the motor drives one of two scroll members which are constrained, by the use of a device such as an Oldham coupling, to movement such that one scroll member orbits with respect to the other.

Such orbital motion, in the proper direction, causes the cyclical creation of pockets at the radially outward ends of the interleaved involute wraps of the scroll members. Such pockets fill with suction gas, close and are displaced radially inward, compressing the gas trapped therein in the process. The compression pockets are displaced into communication with a discharge port at the center of the scroll set and the compressed gas is expelled therethrough.

In low-side scroll compressors used in refrigeration applications, refrigerant gas at suction pressure must be delivered to the vicinity of the suction pockets cyclically defined by the radially outward ends of the wraps of the scroll members. Unless a suction tube of some sort is used, a portion of the compressor shell and/or a frame in the shell of the compressor will most typically define at least a portion of the flow path by which such suction gas is delivered from exterior of the compressor shell to the suction pockets.

As is typical in most compressors, the motors by which scroll compressors are driven must be proactively cooled in order to prevent their overheating during operation. Further, provision must be made for the lubrication of the bearings in which the drive shaft and driven scroll member rotates as well as for the lubrication of other surfaces in the compressor, including thrust surfaces and the surfaces of compressor components, such as the Oldham coupling.

The flow and delivery of lubricant to surfaces requiring lubrication through the low-side of the shell of a scroll compressor, its interaction with the suction gas flowing therethrough to the compression mechanism and the need to cool the motor by which the drive scroll member is driven all create the need to carefully manage and control the flow, use, interaction and separation of lubricant and gas in a low-side scroll compressor to maximize compressor efficiency and to ensure that sufficient lubricant remains in the shell and is not carried thereoutof in the gas which undergoes compression.

SUMMARY OF THE INVENTION

It is an object of the present invention to control and manage the flow of gas in the suction pressure portion of a low-side scroll compressor in a manner which provides for the cooling of the compressor drive motor.

It is a further object of the present invention to control and manage the flow of lubricant in the suction pressure portion of a low-side scroll compressor in a manner which provides for adequate lubrication of the surfaces within that portion of the compressor which require lubrication.

As a still further object of the present invention to control and manage the flow, use, interaction and separation of lubricant and gas in a low-side scroll compressor in a manner which maximizes compressor efficiency and prevents the flow of excessive amounts of lubricant out of the compressor in the gas stream flowing therethrough.

It is another object of the present invention to take advantage of pressure differentials which develop in the suction pressure portion of a low-side scroll compressor, when the compressor is in operation, to assist in the delivery of lubricant to surfaces within that portion of the compressor requiring lubrication.

It is a still further object of the present invention to manage the flow of refrigerant gas and oil in the suction pressure portion of a low-side refrigerant scroll compressor where the compressor drive shaft is accommodated in journal type bearings and drives the driven scroll member directly through the interface of a stub shaft with a boss depending from the end plate of the driven scroll member.

These and other objects of the present invention, which will be appreciated when the following Description of the Preferred Embodiment and attached drawing figures are considered, are accomplished in a scroll compressor having a drive motor which is mounted in a sleeve, the sleeve being fixedly attached to a multi-ported frame in the suction pressure portion of the compressor shell. The motor and motor sleeve cooperate in a definition of flow channels therebetween through which suction gas entering the suction pressure portion of the shell is constrained to flow. Suction gas enters the channels defined by the shell and motor through apertures defined in the shell as well as through the lower open end of the sleeve in which the drive motor is mounted. The flow path defined by the motor and sleeve and the conduct of suction gas therethrough provides for the cooling of the drive motor.

Lubricant from a sump in the suction pressure portion of the shell is pumped upward through a gallery defined in the drive shaft on which the rotor of the drive motor is mounted and through which the driven scroll member is driven. Oil flowing through that gallery is ported to a lower drive shaft bearing, an upper drive shaft bearing and to the surface of a stub shaft at the upper end of the drive shaft which drives the driven scroll member through direct contact with a boss which extends from the end plate of that scroll member.

The delivery of oil to the bearing surfaces and stub shaft is assisted by the venting of the drive shaft or gallery to a location in the suction pressure portion of the shell which, when the compressor is in operation, is at a pressure lower than the pressure in the oil sump which is likewise located in that portion of the compressor shell. The lower pressure develops as a result of the high speed rotation of the drive motor rotor in the proximity of the motor stator, the sleeve and the multi-ported frame and the flow of suction gas through and past the sleeve and motor.

The multi-ported frame, which supports the motor sleeve and stator of the drive motor, is configured to return the majority of the lubricant used for upper bearing and stub shaft lubrication to the oil sump via an essentially discrete flow path separate from the active flow path for suction gas through the shell. In that regard, the separation of such oil for return to the oil sump is in a cavity defined by the frame which is remote from the flow path of suction gas, also defined by the frame, to the scroll set.

DESCRIPTION OF THE DRAWING FIGURES

DESCRIPTION OF THE PREFERRED EMBODIMENT

Figure 1:
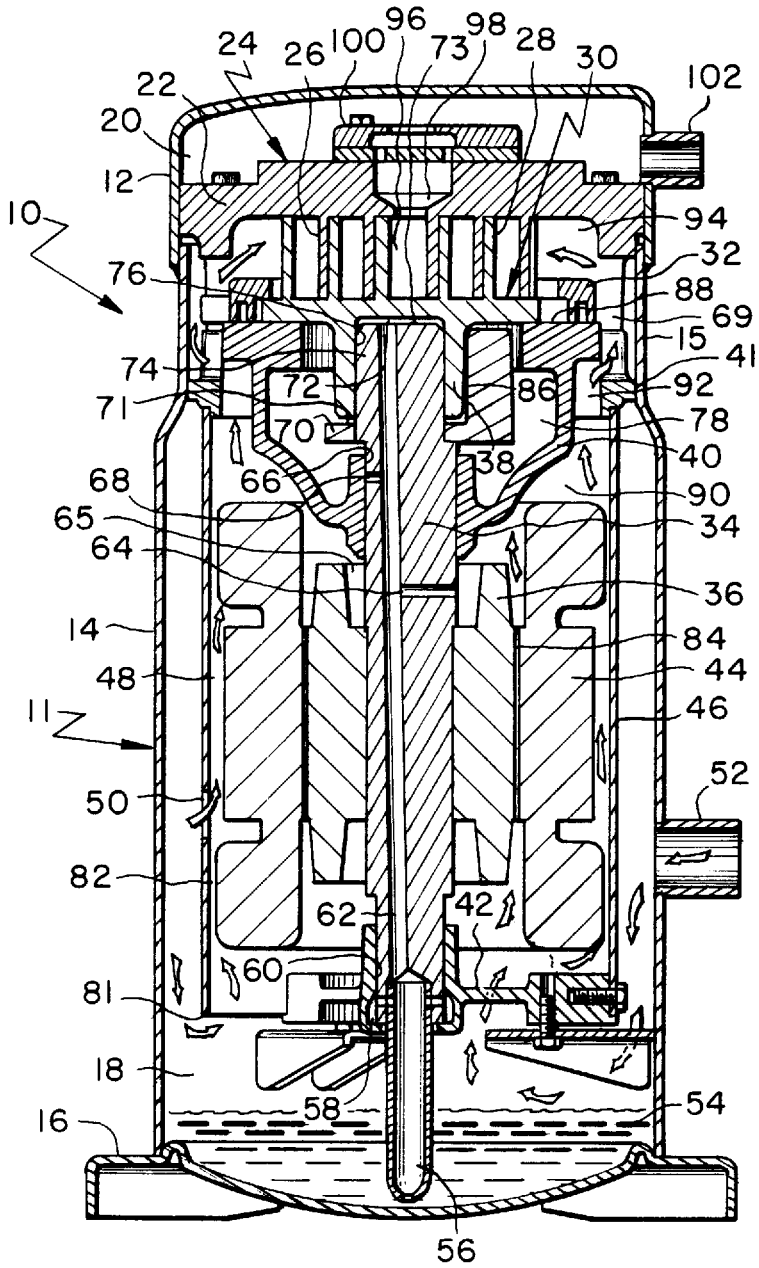
FIG. 1 is a cross-sectional view of the low-side refrigerant scroll compressor of the present invention, best illustrating the flow of suction gas through the suction pressure portion of the compressor's shell.
Figure 2:
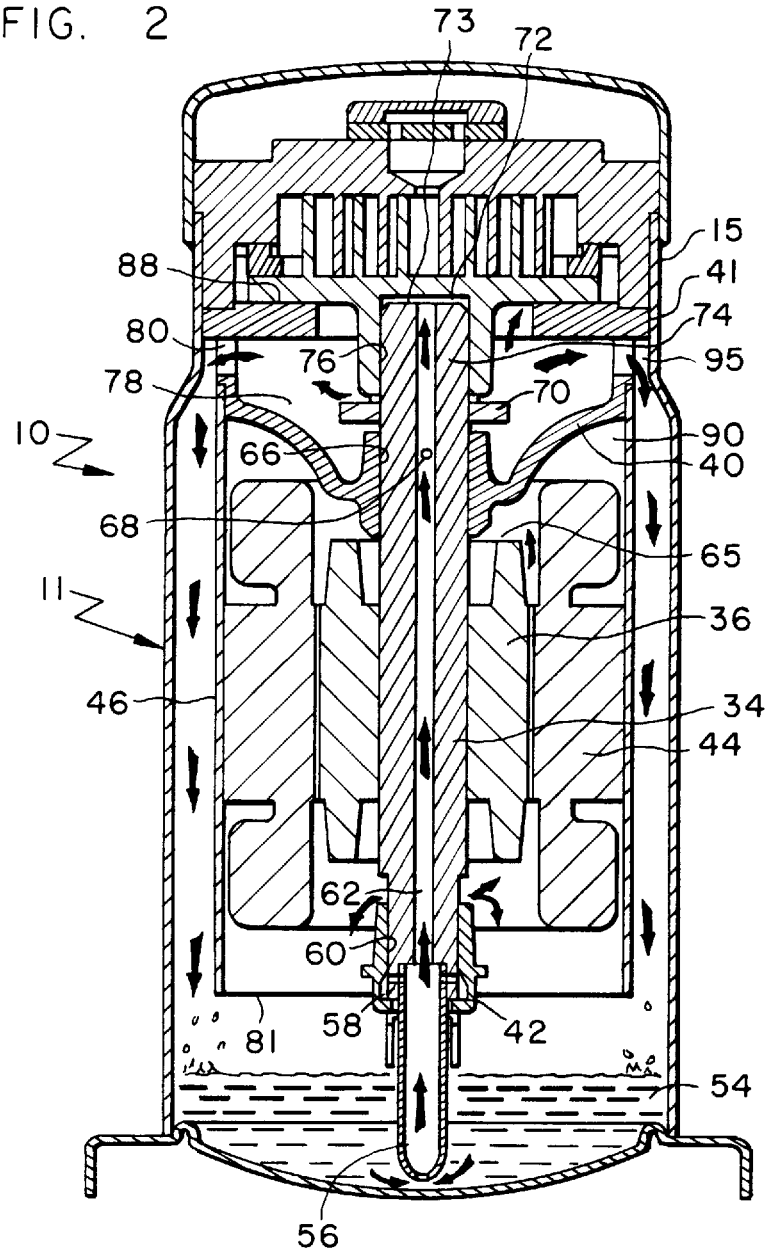
FIG. 2 is likewise a cross-sectional view of the compressor of the present invention taken 90° apart from the cross-sectional view of FIG. 1 and best illustrating the flow of oil through the suction pressure portion of the compressor's shell.
Figure 3:
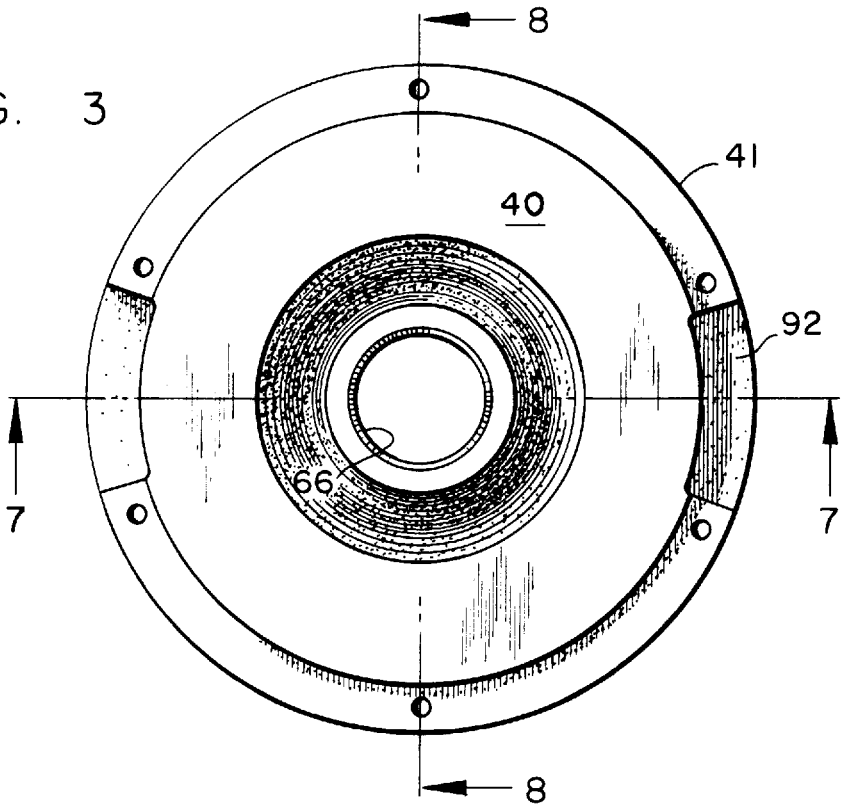
FIG. 3 is a top view of the multi-ported frame in which the drive shaft of the motor of the compressor of the present invention rotates and which defines discrete gas and lubricant flow paths within the suction pressure portion of the compressor shell.
Figure 4:
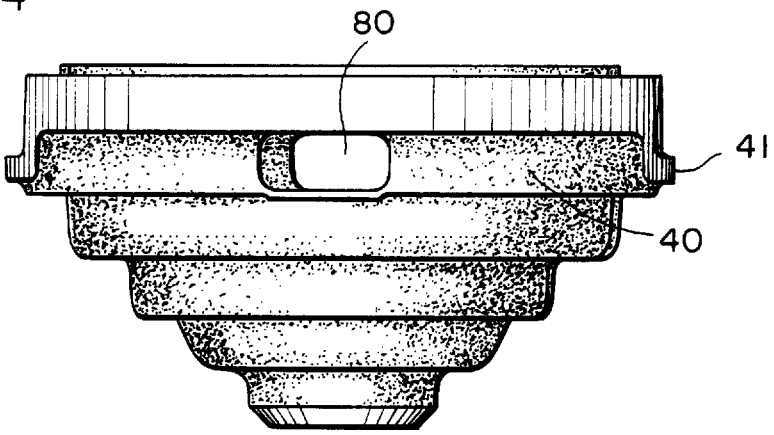
FIG. 4 is a side view of the multi-ported frame of FIG. 3 illustrating the apertures through which oil is returned to the sump of the compressor of the present invention.
Figure 5:
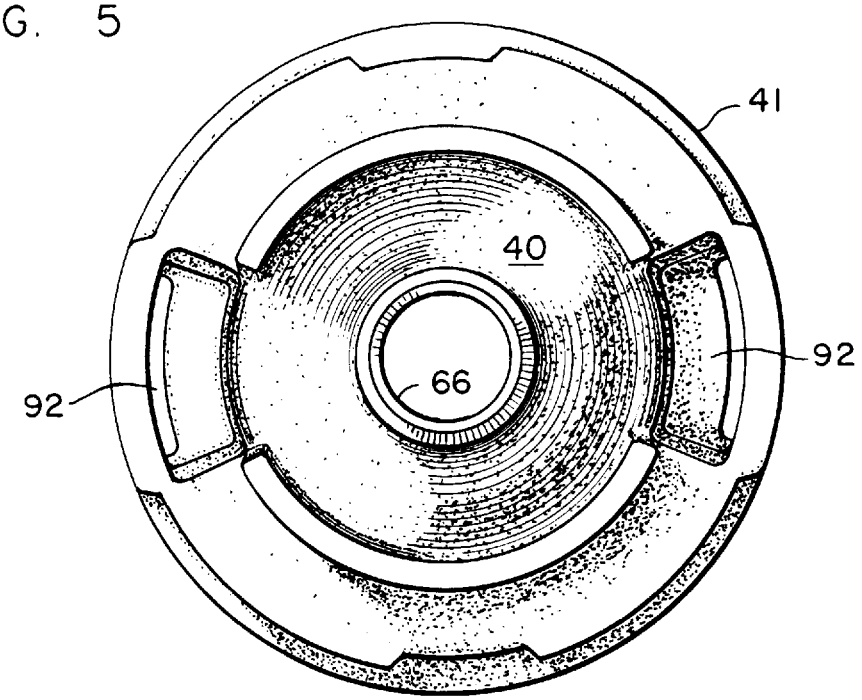
FIG. 5 is a bottom view of the multi-ported frame of FIG. 3.
Figure 6:
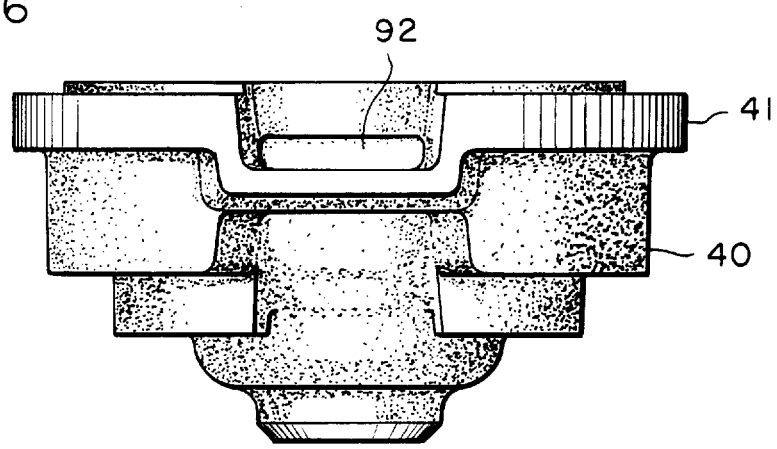
FIG. 6 is a side view of the multi-ported frame of FIG. 3 illustrating the apertures through which suction gas is delivered to the scroll set which comprises the compression mechanism of the present invention.

Referring first to Drawing FIGS. 1 and 2, it is noted that they are cross-sectional views of the compressor 10 of the present invention taken 90° apart with FIG. 2 best illustrating oil flow and FIG. 1 best illustrating gas flow in the suction pressure portion of the compressor.

In that regard, compressor 10 has a hermetic shell 11 which consists of a cap 12, a middle shell 14 which has a necked-in portion 15, and a lower end plate 16. Shell 11 is divided into a low or suction pressure portion 18 and a high or discharge pressure portion 20 by, in this embodiment, the end plate 22 of fixed scroll member 24.

Fixed scroll member 24 has a scroll wrap 26 extending from it which is in interleaved engagement with scroll wrap 28 of orbiting scroll member 30. The fixed and orbiting scroll members together constitute the compression mechanism of compressor 10. Oldham coupling 32 constrains scroll member 30 to orbit with respect to fixed scroll member 24 when the compressor is in operation. It should be understood that the embodiment of FIGS. 1 and 2, while directed to a scroll compressor of the fixed/orbiting type, suggests only the preferred embodiment of the present invention and that the present invention is equally applicable to scroll compressors of other types.

Orbiting scroll member 30, from which boss 38 depends, is driven by drive shaft 34 on which motor rotor 36 is mounted. Drive shaft 34 is, in turn, supported for rotation within multi-ported frame 40 and lower frame 42, both of which are fixedly mounted in the compressor shell. Surface 41 of frame 40, as will further be described, cooperates with necked-in portion 15 of middle shell 14 in the creation of a boundary/barrier between the relatively oil-free flow stream of suction gas delivered to the compression mechanism and the flow path by which oil is returned to the sump of compressor 10 after having been used for lubrication in suction pressure portion 18 of shell 11.

Motor stator 44 is fixedly supported within a sleeve 46 which itself is fixedly attached to and depends from upper frame 40. Flats on the motor stator 44, in cooperation with sleeve 46 define flow channels 48 between the motor stator and sleeve. Sleeve 46, in the preferred embodiment, also defines flow apertures 50 through which suction gas, which enters the compressor shell through suction fitting 52, is introduced directly into channels 48 in the vicinity of the lower middle portion of the motor stator. The definition of apertures 50 in sleeve 46 may, with respect to particular compressors, be dispensed with.

An oil sump 54 is defined at the bottom of shell 11 and a lubricant pump 56 depends thereinto. Lubricant pump 56 is attached to drive shaft 34 and the rotation of pump 56 induces oil from sump 54 to travel upward through the drive shaft. In the preferred embodiment of the present invention, pump 56 is of the centrifugal type although the use of pumping mechanisms of other types, including those of the positive displacement type, are contemplated.

Debris in the oil is centrifugally spun into an annular collection area 58 within lower frame 42. Such debris is returned to the sump through a weep hole, not shown. The oil spun into collection area 58 is end fed to the bearing surface 60 of lower frame 42 in which the lower end of the drive shaft rotates. A portion of the oil which exits bearing surface 60 at its upper end is picked up by suction gas traveling upward through that area, as will further be described, while the balance falls back into sump 54.

Another portion of the oil introduced into drive shaft 34 by the operation of pump 56 continues upward through the drive shaft through a preferably slanted, off-center oil gallery 62. A vent passage 64 connects oil gallery 62 with the exterior of the crankshaft in the region 65 at the upper portion of motor rotor 36.

Vent passage 64 is significant for two reasons. First, it permits the outgassing of refrigerant entrained in the oil traversing gallery 62 before such oil is delivered to the upper bearing surface 66 in frame 40 of the compressor and second, it induces the flow of oil up the shaft in gallery 62 all for the reason that region 65, which is immediately above the motor rotor, is at a relatively lower pressure than the pressure found in oil sump 54 when the compressor is in operation.

The location of vent passage 64 and the reduced pressure at its outlet in region 65 results in a pressure drop in the oil flowing up gallery 62 and effectively lifts oil out of the sump. This in turn reduces the lift which must be accomplished by oil pump 56 itself or, in another sense, increases pump output. The creation of relatively lower pressure region 65 in the vicinity of vent 64 results from the high speed rotation of rotor 36 in the proximity of the upper end of stator 44 and the depending portion of upper frame 40 and from the upward flow of suction gas through and past the drive motor and sleeve.

Upper bearing surface 66, in which the upper portion of drive shaft 34 is rotatably supported, is fed through a cross-drilled lubrication passage 68 which communicates between gallery 62 and bearing surface 66. Passage 68 opens onto an upper portion of bearing surface 66.

Any oil which exits the lower portion of bearing surface 66 along with any oil which might, under some operating conditions, exit vent passage 64 in region 65 is picked up by suction gas flowing out of the gap 84 between rotor 36 and stator 44 into region 65. Such oil, which is modest in quantity but is necessary and sufficient for the lubrication of compressor components such as Oldham coupling 32 and to seal and lubricate the tips and flanks of the scroll wraps, is then carried in the suction gas through frame 40 and into the vicinity 69 of the Oldham coupling as is illustrated in FIG. 1.

A second or upper oil gallery 72 is defined by orbiting scroll member 30 and boss 38 thereof along with the upper end 73 of stub shaft 74 of the drive shaft. Oil directed into upper gallery 72 from drive shaft gallery 62 makes it way down drive surface 76 which is the interface between stub shaft 74 and the interior surface of boss 38. Lubricant which exits the upper portion of bearing surface 66 in the vicinity of the bottom of counterweight 70 and which exits the lower portion of drive surface 76 onto counterweight surface 71 intermixes and is thrown centrifugally outward in counterweight cavity 78 by the high speed rotation of the drive shaft and counterweight therein. This oil flows out of cavity 78 through oil return apertures 80 of multi-ported frame 40 (shown in FIG. 2) and is delivered to an area exterior of sleeve 46 from where it returns to sump 54.

It is to be noted that a longitudinal flat (not shown) may be milled on the exterior surface of stub shaft 74 to better distribute oil thereacross and to act as an overflow path for excess oil which makes its way into gallery 72. Such a flat, if provided, will be milled in a portion of boss 38 which is not loaded by the driving of the orbiting scroll member through stub shaft 74.

It is also to be noted that a portion of the oil exiting the lower portion of drive surface 76 onto counterweight surface 71 will, as well, be urged centrifugally outward and travel up the inside radius of counterweight 70 through gap 86, which is best illustrated in FIG. 1. This oil provides for the lubrication of the underside of orbiting scroll member 30 in its contact with thrust surface 88 which is an upward facing surface of multi-ported frame 40. Once again, any oil which is excess to that need is delivered, as a result of the rotation of the drive shaft and counterweight in cavity 78, centrifugally out of cavity 78 through oil return apertures 80 to the exterior of motor sleeve 46 and ultimately back to oil sump 54.

Figure 7:
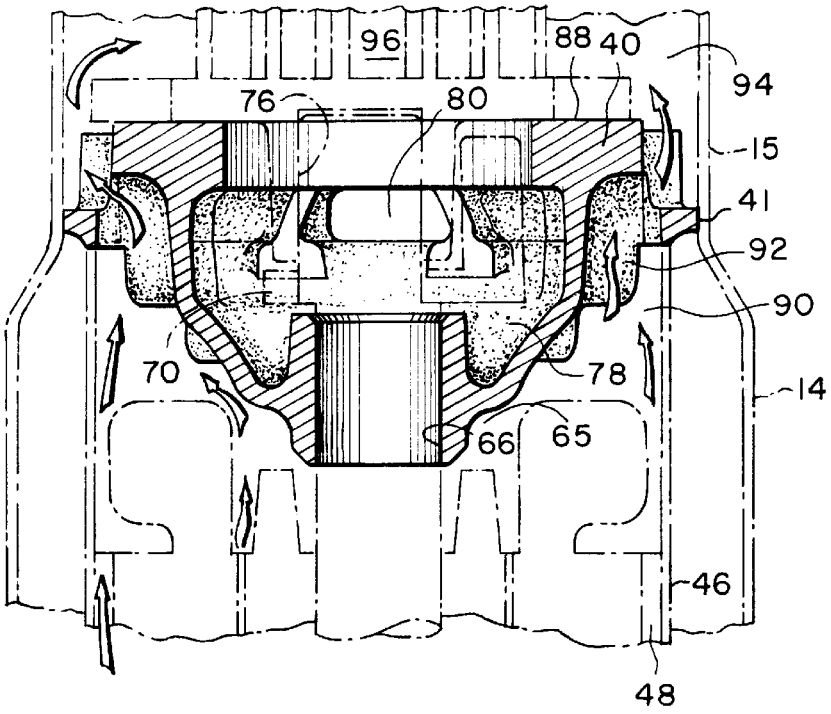
FIG. 7 is a cross-sectional view of the multi-ported frame of FIG. 3 taken along line 7—7 thereof, line 7—7 bisecting the apertures through which gas is delivered to the scroll set.

With respect to suction gas flow and with particular reference to FIGS. 1 and 7, it is to be noted that suction gas entering suction fitting 52, in addition to entering apertures 50 and channels 48 directly, flows downward and around the lower edge 81 of sleeve 46. The gas then flows upwardly, around and past the lower portion of motor stator 44 through lower passages 82, defined between the lower portion of motor stator 44 and sleeve 46, and through the gap 84 defined between motor rotor 36 and motor stator 44. This flow path for suction gas constitutes a first portion of the flow path by which suction gas is directed to the compression mechanism.

It is to be noted that suction gas entering apertures 50 of sleeve 46 and flowing around lower edge 81 thereof will be relatively oil free. This is because the suction gas entering shell 11 of the compressor through fitting 52 is relatively oil-free and because the change in gas flow direction and velocity occasioned by the entry of the suction gas into the interior of sleeve 46 has the affect of disentraining lubricant which is already entrained in the suction gas as it enters the shell or which is picked up by the suction gas in its flow from suction fitting 52 into sleeve 46.

Suction gas which flows through passages 82 and channels 48, through rotor-stator gap 84, around and through the lower portion of the motor rotor and stator and to and through region 65 acts, as has been mentioned, to cool the drive motor. The suction gas next flows into an area 90 which is defined by the interior of sleeve 46, the upper portion of motor stator 44 and the exterior surface of multi-ported frame 40. Such gas will, once again, pick up outgassed refrigerant and any lubricant which might be carried out of drive shaft vent 64 as well as some of the lubricant exiting the lower portion of bearing surface 66, in its upward travel to and through area 90 and to apertures 92 which are defined by frame 40. That lubricant is, as previously mentioned, limited in quantity but necessary to the lubrication of the Oldham coupling and to the sealing and lubrication of the tips and involute wraps of the scroll members.

Suction gas is delivered out of area 90 through passages 92 and passes, along with the relatively small amount of entrained lubricant, radially outward and upward of frame 40 into suction area 94 which surrounds the wraps of the scroll set. The gas flow path commencing in area 90 constitutes a second portion of the flow path by which suction gas is directed to the compression mechanism. It is important to note that surface 41 of multi-ported frame 40 is ensconced in necked-in portion 15 of middle shell 14 so as to create a relatively sealed boundary or barrier between the flow of the relatively oil-free suction gas as it flows out of passages 92 to suction area 94 and the relatively oil-saturated area 95 radially exterior of oil-return passages 80 which are defined by multi-ported frame 40.

Suction area 94 is in flow communication with the suction pockets which are cyclically formed by the orbiting of scroll member 30 with respect to the fixed scroll member 24. Compression of the gas in the trapped pockets as they close off from area 94 then occurs as has been described. Gas compressed between the drive and driven scroll members is conducted radially inward into discharge pocket 96 out of which it is communicated through discharge port 98. The gas passes through discharge check valve assembly 100 into discharge pressure portion 20 of the compressor shell and is communicated thereoutof through discharge fitting 102.

Figure 8:
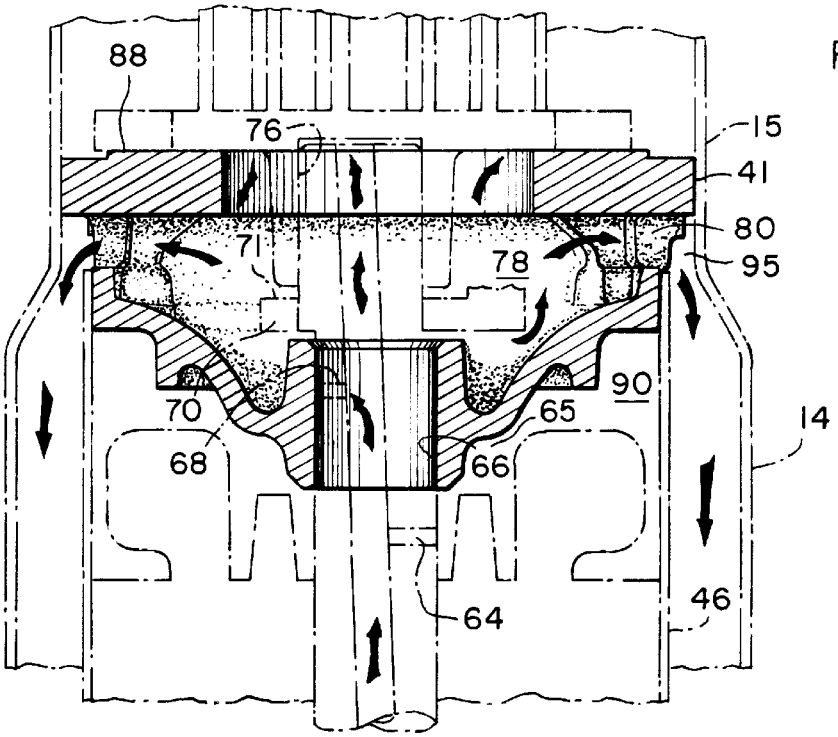
FIG. 8 is a cross-sectional view of the multi-ported frame of FIG. 3 taken along line 8—8 thereof, line 8—8 bisecting the apertures through which oil is returned to the sump in the low side of the compressor of the present invention.

Referring additionally now to the remainder of Drawing Figures, a better appreciation will be had as to how multi-ported frame 40, in conjunction with sleeve 46 manages the relatively discrete and separate flow of oil and suction gas through the suction pressure portion of compressor 10. In that regard and referring primarily to FIGS. 7 and 8, it will be seen that the majority of oil delivered to the upper portion of the suction pressure portion of the compressor shell is delivered for the purpose of lubricating bearing surface 66, drive surface 76 and thrust surface 88. That oil is delivered to and used essentially within the confines of cavity 78 which is, once again, defined by the interior of multi-ported frame 40. Subsequent to its use and upon entering cavity 78, as has been described, the oil is thrown centrifugally outward by the rotation of the upper end of drive shaft 34 and counterweight 70. That oil is redelivered, through oil return apertures 80 of frame 40 and through area 95, to sump 54 via a flow path which is exterior of motor sleeve 46 and which is isolated from the suction gas flowing therethrough.

The flow path for suction gas delivered to the scroll set is defined so as to be isolated from oil-rich cavity 78. The isolation of the suction gas flow stream from cavity 78 and from the oil which is returned thereoutof to sump 54 is accomplished by the definition of a suction gas flow path which is interior of motor sleeve 46 and exterior of the portion of frame 40 which defines oil-rich cavity 78. Multi-ported frame 40, in cooperation with middle shell 14, therefore successfully directs oil out of ports 80 and through area 95 for return to the sump and while directing relatively oil-free suction gas through ports 92 to suction area 94 in the vicinity of scroll set.

It will be appreciated that the active flow path for suction gas within the compressor is largely independent of both the supply and return flow paths for lubricating oil therein. This is as a result of the use of a multi-ported frame and sleeve that cooperate to channel suction gas to the scroll set via an active gas flow path that is effectively isolated from the areas within the suction pressure portion of the compressor where lubricant is used and from which lubricant is returned to the oil sump. The oil delivery, use and return paths, while likewise containing suction gas, are not, generally speaking, paths by which suction gas is actively conducted to the compression mechanism. As a result, the necessary lubrication of surfaces requiring lubrication in the suction pressure portion of the compressor is achieved while the suction gas delivered to the scroll set is relatively oil-free, other than with respect to a relatively nominal amount of oil needed for the lubrication of components and surfaces in the vicinity thereof.

While the compressor of the present invention has been described in terms of a preferred embodiment, it will be appreciated that alternatives and variances thereto fall within the scope of the invention as set forth in the following claims.

What is claimed is:

1. A method for cooling the motor of a low-side scroll compressor and for delivering relatively oil-free suction gas to the scroll compression mechanism thereof comprising the steps of:

dividing the shell of said compressor into a suction pressure portion and a discharge pressure portion;

defining an oil sump in the suction pressure portion of the shell;

mounting a sleeve-encased drive motor to a frame in the shell, the sleeve of said sleeve-encased drive motor being open-ended, the frame cooperating with the sleeve-encased motor to define a flow path for suction gas through the interior of the sleeve-encased motor to the scroll set, the flow path so defined causing such suction gas to cool the motor, suction gas being delivered into the suction pressure portion of the shell of the compressor exterior of the sleeve-encased motor prior to flowing into the flow path for suction gas defined interior of the sleeve-encased motor;

driving one of the scroll members with the drive shaft of the sleeve-encased drive motor;

delivering oil, through the flow path defined by the drive shaft of the sleeve-encased motor, from the sump to the bearing surfaces in which the drive shaft is rotatably accommodated and to the surface of the drive shaft which drives the one of the scroll members;

collecting oil, subsequent to its use in the delivering step, in a cavity defined by the frame, the cavity being isolated from the suction gas flow path internal of the sleeve-encased motor; and returning oil from the cavity to the sump via a flow path which is external of the sleeve-encased motor and which is isolated from the flow path for suction gas defined interior of the sleeve-encased motor.

2. The method according to claim 1 comprising the further steps of creating, through the operation of the motor, a region internal of the sleeve and external of the frame, which is at a pressure relatively lower than the pressure of oil in the sump; and, inducing oil flow through the oil flow path defined by the drive shaft by the venting of the oil flow path through the drive shaft to the lower pressure region.

3. The method according to claim 2 further comprising the steps of constraining oil collected in said collecting step to return to said sump through an oil-return aperture defined in said frame, there being at least one such oil-return aperture defined in said frame, and constraining the suction gas which flows through the sleeve-mounted motor to flow to the compression mechanism through a suction gas aperture defined in the frame, there being at least one such suction gas aperture defined in said frame, the at least one suction gas aperture in the frame being isolated both from the cavity and from the at least one oil return aperture so that suction gas does not mix with collected oil subsequent to entry of the suction gas into the interior of the sleeve.

* * * * *